United States Patent [19]

Johnson

[11] Patent Number: 4,472,714

[45] Date of Patent: Sep. 18, 1984

[54] CLOCK SYNCHRONIZATION CIRCUIT FOR CONTROL OF TRAFFIC SIGNALS

[75] Inventor: Wilbur E. Johnson, Anaheim, Calif.

[73] Assignee: Econolite Control Products, Inc., Anaheim, Calif.

[21] Appl. No.: 460,116

[22] Filed: Jan. 21, 1983

[51] Int. Cl.[3] ..... G08G 1/07; G08B 1/00

[52] U.S. Cl. ..... 340/916; 340/912; 340/931; 340/333

[58] Field of Search ..... 340/41 R, 46, 35, 40, 340/309.15, 333, 916, 912, 931; 364/436

[56] References Cited

U.S. PATENT DOCUMENTS

| | | | |
|---|---|---|---|
| 3,175,183 | 3/1965 | Willyard | 340/41 R |
| 3,509,358 | 4/1970 | Guido | 340/35 |
| 3,818,429 | 6/1974 | Meyer | 340/41 R |
| 3,825,890 | 7/1974 | Miyazato | 340/41 R |
| 4,008,404 | 2/1977 | Foreman | 340/41 R |

*Primary Examiner*—James J. Groody

*Attorney, Agent, or Firm*—Edward A. Sokolski

[57] ABSTRACT

A device used in the control of automobile traffic signal systems for maintaining a local time reference during periods when the a.c. power is interrupted. An accurate oscillator such as a crystal controlled oscillator is used to provide a local time reference during power interruptions. The device maintains a local clock in synchronism with the a.c. power when the power is present and maintains the time reference in synchronism with the crystal oscillator during those periods when the a.c. power is absent. Pulse trains at different rates generated in synchronism with the oscillator are combined to achieve these objects.

8 Claims, 2 Drawing Figures

CLOCK SYNCHRONIZATION CIRCUIT FOR CONTROL OF TRAFFIC SIGNALS

BACKGROUND OF THE INVENTION

This invention pertains to devices for the control and synchronization of automobile traffic signals. More particularly, this invention pertains to the synchronization of local time clocks used in traffic signal control devices.

DESCRIPTION OF THE PRIOR ART

Digital devices which count the zero crossings of the alternating current (a.c.) electrical power supplied to the traffic signals have been used as clocks to provide a time reference for the synchronization of signals in an automobile traffic control system. However, an interruption in the a.c. electrical power source causes the time indicated by such digital counters to be incorrect.

In an attempt to avoid this problem, a local oscillator operating at the frequency or a multiple of the frequency of the alternating current power source in combination with a counter has been used to measure the amount of time that elapses during any power interruption. In other instances an oscillator driven clock emitting one pulse per second has been used to measure the elapsed time. When power is restored, the length of the interruption is added to that of the clock to make an approximate correction for the interruption. The prior art devices, however, suffered from various inaccuracies. In some instances, the a.c. power source was examined or tested only once a second to determine if it was present or absent. As a consequence, an error up to one second per interruption would occur in the measurement of the time interval during which the power was absent. In other devices of the prior art, the presence of the a.c. power was checked more frequently, but the duration of the interruption in power was still not measured accurately, with the result that significant timing errors could accumulate after a series of power interruptions.

SUMMARY OF THE INVENTION

The synchronization circuit described here provides a time reference for the clock which, in operation, is absolutely synchronized with the phase of the alternating current power source so long as the a.c. power is present. During periods when the a.c. power is absent, the clock is accurately controlled by a crystal oscillator so as to continue to be in close approximation to the phase of the alternating current power supply.

This invention uses a crystal controlled oscillator and a pulse generator to generate pulses to drive a clock, which clock in turn, provides the local time reference. When the 60 hz a.c. power source is present this invention supplies exactly 4,096 pulses to the clock during each one-eighth of a second, that is, during the period occupied by 15 zero crossings of the a.c. power source. During periods when the power source is interrupted, approximately 4,096 pulses are supplied to the clock during each one-eighth of a second, the accuracy being determined by the accuracy of the crystal oscillator.

BRIEF DESCRIPTION OF THE PREFERRED EMBODIMENT

Figure 1:
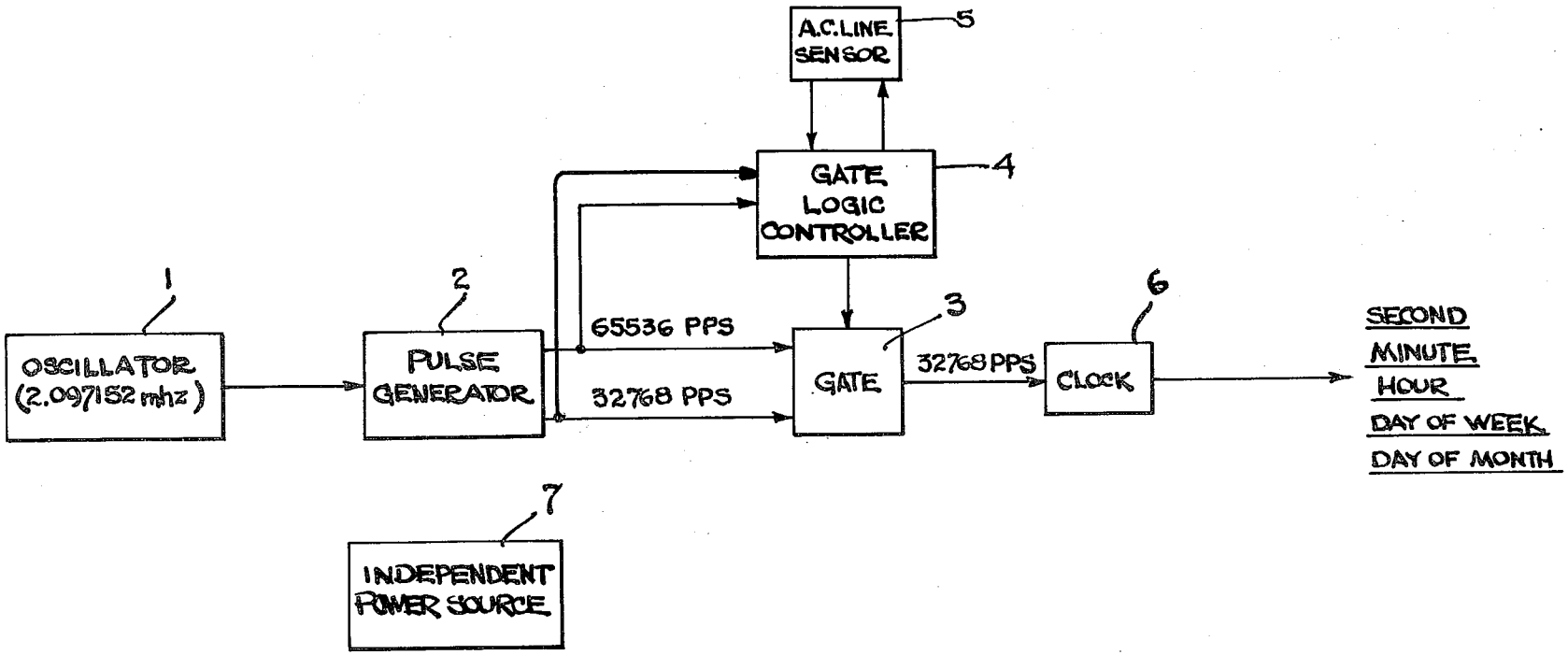
FIG. 1 is a functional block diagram of the invention.

FIG. 1 shows the block diagram of this invention as it is used for synchronizing a local time reference or clock with a 60 hz alternating current power source. Oscillator 1, which is a crystal controlled oscillator, operates at a frequency of 2.097152 megahertz and provides a sine wave at this frequency to pulse generator 2. Pulse generator 2 divides the oscillator frequency by 32 to generate a chain of pulses at the rate of 65,536 pulses per second and divides this pulse train by 2 to generate a second pulse train at the rate of 32,768 pulses per second.

Gate 3 passes segments of the two pulse trains generated by pulse generator 2 to clock 6. A total of 32,768 pulses per second are transferred through gate 3 to clock 6. Clock 6 requires just this number of pulses per second to "keep time" correctly. Clock 6 outputs the second, minute, hour, day of week, day of month and the year. The output of clock 6 is used by the traffic control device to operate the signal in synchronism with other traffic signals in the system.

Gate logic controller 4 operates in synchronism with the pulse train received by it from pulse generator 2 to control the passage of the two pulse trains through gate 3 to clock 6. Gate logic controller 4, in its sequence of operation, periodically resets and enables a.c. line sensor 5 which, in turn, then indicates to gate logic controller 4 when a zero crossing in the a.c. current has occurred following such reset.

Independent power source 7 contains a battery which supplies power to the clock synchronization circuit during the periods when the a.c. power is absent.

Figure 2:
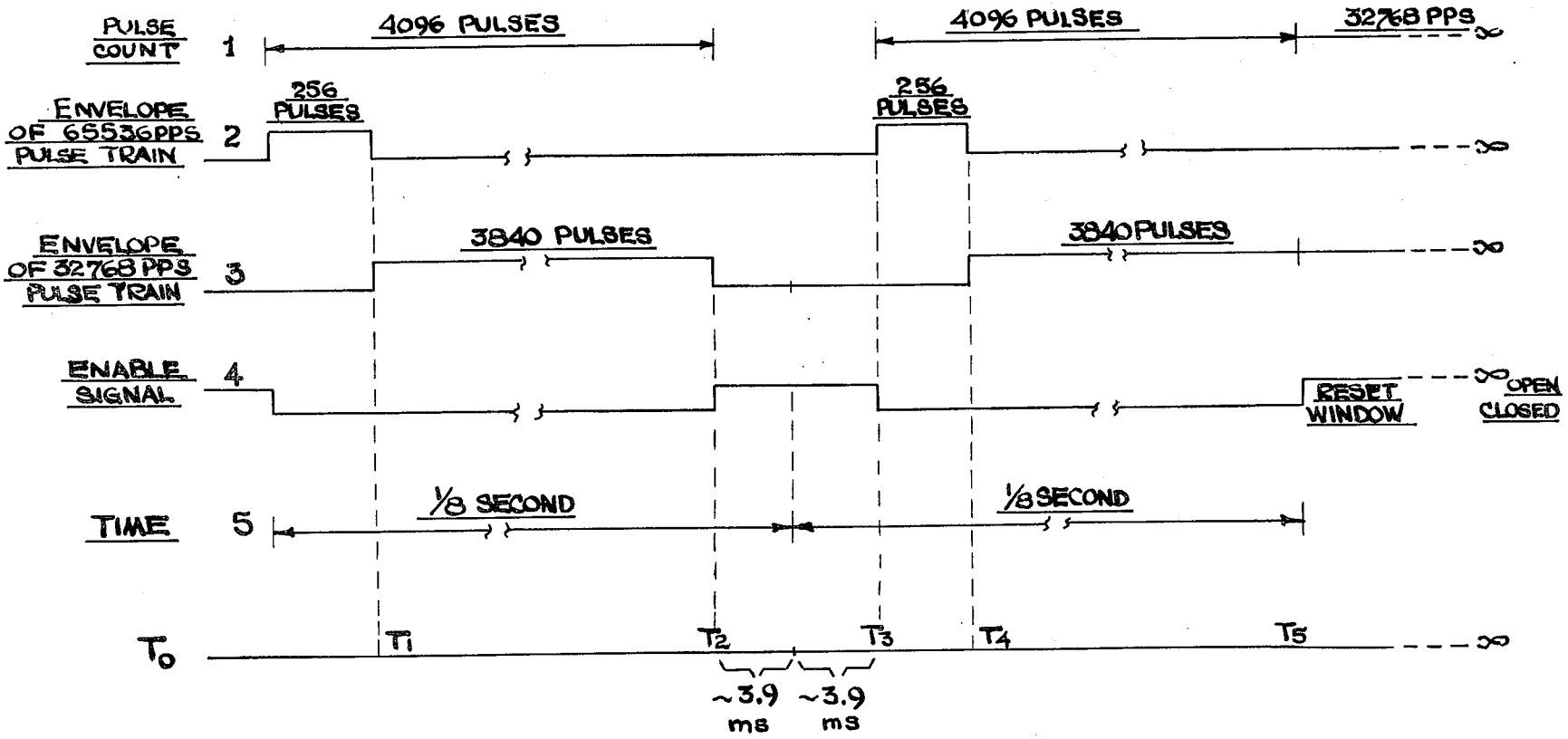
FIG. 2 depicts the timing of the pulse trains supplied to the clock by the pulse generator.

FIG. 2 depicts the temporal sequence in which the pulse trains from generator 2 are passed to clock 6 by gate 3. Gate logic controller 4 operates in a periodic manner over a period of one-eighth second, which period corresponds to 15 zero crossings of the 60 hz a.c. power source. Line 2 in FIG. 2 indicates the portion of the one-eighth second interval during which pulses from the 65,536 pulses per second pulse train are transmitted by gate 3 to clock 6. Exactly 256 pulses of the 65,536 PPS train of pulses is transmitted during the period from $T_0$ to $T_1$.

At $T_1$ gate 3 turns off the 65,536 pulse train and, as indicated in Line 3 of FIG. 2, turns on or transmits pulses from the 32,768 PPS train of pulses to clock 6. Exactly 3,840 pulses are transmitted from $T_1$ to $T_2$. As a consequence, exactly 4,096 pulses are transferred to clock 6 during the period from $T_0$ to $T_2$. No pulses are transferred to clock 6 during the interval between $T_2$ and $T_3$.

As indicated by Line 4 of FIG. 2, during the interval between $T_2$ and $T_3$ a.c. line sensor 5 is enabled, that is, it is reset at time $T_2$ so as to indicate the occurrence, subsequent to $T_2$, of a zero crossing of the voltage of the a.c. power source. Assuming for the moment that a zero crossing in the a.c. power occurred at time $T_0$, then the 15th subsequent zero crossing would occur one-eighth of a second later at a point in time midway between $T_2$ and $T_3$. The interval, $T_2$ and $T_3$, occupies 7.8 milliseconds which is approximately equal to the 8.3 millisecond interval between zero crossings of the 60 hz power source. If a zero crossing is sensed by a.c. line sensor 5 during the interval from $T_2$ and $T_3$ the operation of gate logic controller 4 is immediately reset to $T_0$ and the sequence just described repeats. Thus, so long as the a.c.

power is present at each one-eighth second interval, gate 3 supplies exactly 4,096 pulses to clock 6 during the one-eighth second interval occupied by 15 zero crossings of the a.c. power and thus supplies exactly 32,768 pulses each second to clock 6, which is the number of pulses required by clock 6 to maintain correct time. An OKI MSM 5832 or National MM 58174 semiconductor is suitable for use as clock 6.

When the a.c. power is absent, the device operates as a "self-timer" using the frequency of oscillator 2 as a time reference in the following described manner.

If, during the interval $T_2$ to $T_3$, a zero crossing of the a.c. power source is not sensed by a.c. line sensor 5, then the operation of gate logic controller 4 proceeds through $T_4$ and $T_5$ and onward in the manner depicted in FIG. 2. As indicated by line 2 of FIG. 2, 256 pulses of the 65,536 PPS pulse train are transferred by gate 3 to clock 6 during the interval from $T_3$ to $T_4$ and, as indicated by line 3, 3,840 pulses of the 32,768 PPS train are transferred to clock 6 during the interval from $T_4$ to $T_5$, again providing exactly 4,096 pulses to clock 6 during the second one-eighth second time interval. From $T_5$ onward, until a zero crossing is sensed by a.c. line sensor 5, gate 3 transmits a continuous stream of pulses from the 32,768 PPS pulse train to clock 6 thus supplying clock 6 with 32,768 pulses per second, the number required for correct time keeping.

As indicated by line 4 in FIG. 2, at $T_5$ a.c. line sensor 5 is reset and enabled so that at such time as a zero crossing is detected subsequent to $T_5$ by a.c. line sensor 5, the signal or flag indicating the zero crossing is transferred to gate logic controller 4 which causes the controller to be reset to time $T_0$. Gate logic controller 4 then reverts to the sequence of operation from $T_0$ as described above.

From the preceeding description, it is apparent that, so long as a.c. power is present, exactly 32,768 pulses are supplied to clock 6 for each 60 cycles of the a.c. power source and hence the accuracy of clock 6 is determined entirely by the number of cycles of a.c. current occuring each second. It is also apparent that during those periods when the a.c. power is absent, the accuracy of clock 6 operating as a "self-timer" mode is determined by the accuracy of the frequency of oscillator 1. As a consequence, errors in the time indicated by clock 6 relative to the a.c. power source will accrue only to the extent of the error in the frequency of oscillator 1 during those periods when the a.c. power is interrupted. If the accuracy of oscillator 1 is maintained to one part in $10^6$, error will accrue only at the rate of one second for each million seconds that the a.c. power is absent, i.e. at the rate of 3.6 ms per hour. For a lower accuracy of perhaps 25 parts in $10^6$, error would accrue at the rate of 0.09 seconds per hour.

Although a particular oscillator frequency and specific pulse rates have been used in describing the preferred embodiment of this invention, other oscillator frequencies and pulse rates could be used instead. Furthermore, the two pulse trains need not be harmonically related and more than two pulse trains could be used in combination. It also should be apparent that an interval of other than one-eighth second also could be used as the nominal operation interval for this invention. The only requirements of the invention are that the total number of pulses supplied by gate 3 from the combination of pulse trains during the nominal interval of operation (one-eighth second in the preferred embodiment) must be just that number of pulses required by clock 6 during the nominal operation interval to keep correct time, and that the number of pulses per second supplied by gate 3 to clock 6 during those intervals when the a.c. power is absent, must, to the accuracy of the secondary time base provided by oscillator 1, also be the number required by clock 6 to keep correct time. It should also be apparent that this device, with appropriate modifications, can be used with a.c. power sources having frequencies other than 60 hz.

I claim:

1. A device for providing a local time reference for the synchronization of the control unit of a traffic light supplied by an alternating current (a.c.) power source comprising:

(a) an oscillator operating at a frequency substantially higher than the frequency of the a.c. power source, (b) clock means for providing a local time reference, (c) synchronizing means for sensing the presence of the a.c. power and for driving the clock means in synchronism with the phase of the a.c. power source during the periods when the a.c. power is present, (d) self timing means for sensing the absence of the a.c. power and for driving the clock means in synchronism with the oscillator during the periods when the a.c. power is absent, (e) a power source independent of the a.c. power source for supplying power to the oscillator, the clock means, the synchronizing means and the self timing means.

2. The device described in claim 1 wherein the synchronizing means and the self timing means comprise (a) pulse generator means for generating first and second pulse trains at two different pulse rates in synchronism with the oscillator, the second train having a higher pulse rate than the first train, (c) control logic and gating means for transferring from the pulse generating means to the clock means, within a specified time interval, a first segment of pulses from the first pulse train followed by a second segment of pulses from the second pulse train followed by a third segment containing no pulses, the control logic and gating means being reset to generate the two segments of pulses followed by a short quiet period of no pulses in the event that a zero crossing of the a.c. electrical power is detected during the quiet period or, in the event that no zero crossing in the a.c. power is detected during the quiet period, the segment of the first pulse train and the segment of the second pulse train being repeated once and then followed by a continuous train of pulses from the second pulse train until a zero crossing in the a.c. current is detected, at which time the control logic and gating means is reset to begin again the recited sequence, (c) the total number of pulses contained in the first and second segments being that number of pulses required by the clock means within the period of time occupied by the first, second and third segments, to maintain a time reference in synchronism with the a.c. power source.

3. The device described in claim 2 wherein the pulse rate of the first train of pulses generated by the pulse generator means is twice the pulse rate of the second train.

4. A device for providing a local time reference for the synchronization of the control unit of a traffic light supplied by an alternating current (a.c.) power source comprising:

(a) an oscillator operating at a frequency substantially higher than the frequency of the a.c. power source, the frequency of the oscillator being controlled to an accurancy of 25 parts in a million or better (b) clock means for providing a local time reference, (c) synchronizing means for sensing the presence of the a.c. power and for driving the clock means in synchronism with the phase of the a.c. power source during the periods when the a.c. power is present, (d) self timing means for sensing the absence of the a.c. power and for driving the clock means in synchronism with the oscillator during the periods when the a.c. power is absent, (e) a power source independent of the a.c. power source for supplying power to the oscillator, the clock means, the synchronizing means and the self timing means.

5. The device described in claim 4 wherein the synchronizing means and the self timing means comprise:

(a) pulse generator means for generating first and second pulse trains at two different pulse rates in synchronism with the oscillator, the second train having a higher pulse rate than the first train, (b) control logic and gating means for transferring from the pulse generating means to the clock means, within a specified time interval, a first segment of pulses from the first pulse train followed by a second segment of pulses from the second pulse train followed by a third segment containing no pulses, the control logic and gating means being reset to generate the two segments of pulses followed by a short quiet period of no pulses in the event that a zero crossing of the a.c. electrical power is detected during the quiet period or, in the event that no zero crossing in the a.c. power is detected during the quiet period, the segment of the first pulse train and the segment of the second pulse train being repeated once and then followed by a continuous train of pulses from the second pulse train until a zero crossing in the a.c. current is detected, at which time the control logic and gating means is reset to begin again the recited sequence, (c) the total total number of pulses contained in the first and second segments being that number of pulses required by the clock means within the period of time occupied by the first, second and third segments, to maintain a time reference in synchronism with the a.c. power source.

6. The device described in claim 5 wherein the pulse rate of the first train of pulses generated by the pulse generator means is twice the pulse rate of the second train.

7. A device for providing a local time reference for the synchronization of the control unit of a traffic light supplied by an alternating current (a.c.) power source comprising:

(a) an oscillator operating at a frequency substantially higher than the frequency of the a.c. power source, (b) clock means for providing a local time reference, (c) pulse generator means for generating first and second pulse trains at two different pulse rates in synchronism with the oscillator, the second train having a higher pulse rate than the first train, (d) control logic and gating means for transferring from the pulse generating means to the clock means, within a specified time interval, a first segment of pulses from the first pulse train followed by a second segment of pulses from the second pulse train followed by a third segment containing no pulses, the control logic and gating means followed by a short quiet period of no pulses in the event that a zero crossing of the a.c. electrical power is detected during the quiet period or, in the event that no zero crossing in the a.c. power is detected during the quiet period, the segment of the first pulse train and the segment of the second pulse train being repeated once and then followed by a continuous train of pulses from the second pulse train until a zero crossing in the a.c. current is detected, at which time the control logic and gating means is reset to begin again the recited sequence, (e) the total number of pulses contained in the first and second segments being that number of pulses required by the clock means within the period of time occupied by the first, second and third segments, to maintain a time reference in synchronism with the a.c. power source.

8. The device described in claim 7 wherein the pulse rate of the first train of pulses generated by the pulse generator means is twice the pulse rate of the second train.

* * * * *